US008750548B2

(12) United States Patent
Christensen et al.

(10) Patent No.: US 8,750,548 B2
(45) Date of Patent: Jun. 10, 2014

(54) LISTENING DEVICE ADAPTED FOR ESTABLISHING AN ELECTRIC CONNECTION TO AN EXTERNAL DEVICE USING ELECTRICALLY CONDUCTIVE PARTS OF ONE OR MORE COMPONENTS OF THE LISTENING DEVICE

(75) Inventors: Niels E. H. Christensen, Smoerum (DK); Kenneth Rueskov Møller, Smoerum (DK); Jan T. L. Larsen, Smoerum (DK)

(73) Assignee: Oticon A/S, Smørum (DK)

( * ) Notice: Subject to any disclaimer, the term of this patent is extended or adjusted under 35 U.S.C. 154(b) by 95 days.

(21) Appl. No.: 13/218,575

(22) Filed: Aug. 26, 2011

(65) Prior Publication Data

US 2012/0051577 A1 Mar. 1, 2012

Related U.S. Application Data

(60) Provisional application No. 61/377,996, filed on Aug. 30, 2010.

(30) Foreign Application Priority Data

Aug. 30, 2010 (EP) ..... 10174484

(51) Int. Cl.
*H04R 25/00* (2006.01)

(52) U.S. Cl.
USPC ..... 381/328; 381/322; 381/323

(58) Field of Classification Search
USPC ..... 381/60, 312, 314, 322, 323, 324, 328, 381/330, 380
See application file for complete search history.

(56) References Cited

U.S. PATENT DOCUMENTS 4,961,230 A * 10/1990 Rising ..... 381/323
5,404,407 A * 4/1995 Weiss ..... 381/314

(Continued)

FOREIGN PATENT DOCUMENTS

DE 102008022925 A1 6/2009
DE 102008024515 B3 4/2010
WO WO 2004/084582 9/2004

OTHER PUBLICATIONS

Search Report dated Oct. 6, 1011, issued in the corresponding European Patent Application No. 10174484.5-1224.

(Continued)

*Primary Examiner* — Huyen D Le
(74) *Attorney, Agent, or Firm* — Buchanan Ingersoll & Rooney PC

(57) ABSTRACT

The application relates to a miniature listening device (20) comprising a housing (200) for enclosing an energy source (23) and a number of functional (21, 22, 24, 60, 70) and/or electronic (251) components of the listening device. The application further relates to the use of such listening device, to a listening system and to a method of electrically connecting a listening device to an external device. The object of the present application is to provide a scheme for electrically connecting a miniature listening device to an external device. The problem is solved in that a first functional component comprises an electric contact part (211), which is physically accessible from outside the housing, and wherein an electronic component and/or said energy source—at least in a specific connected mode—is electrically connected to said electric contact part of the first functional component, whereby an electric connection from an external device to said electronic component and/or to said energy source of the listening device can be established. This has the advantage of providing a listening device that uses a minimum of space on electrical contacts to external devices. The invention may e.g. be used in miniature hearing aids or ear phones or active ear plugs.

13 Claims, 9 Drawing Sheets

(56) References Cited

U.S. PATENT DOCUMENTS

| | | | | |
|---|---|---|---|---|
| 5,586,188 | A | 12/1996 | Renggli et al. | |
| 5,799,095 | A * | 8/1998 | Hanright | 381/312 |
| 6,044,164 | A * | 3/2000 | Ach-Kowalewski | 381/314 |
| 6,731,770 | B1 * | 5/2004 | Vonlanthen | 381/330 |
| 2003/0128855 | A1 | 7/2003 | Moller | |
| 2008/0118093 | A1 | 5/2008 | Klemenz et al. | |
| 2008/0240480 | A1 | 10/2008 | Pinnell et al. | |
| 2009/0067652 | A1 | 3/2009 | Schmidt et al. | |

OTHER PUBLICATIONS

Swedish Search Report issued on Mar. 24, 2010.

* cited by examiner

LISTENING DEVICE ADAPTED FOR ESTABLISHING AN ELECTRIC CONNECTION TO AN EXTERNAL DEVICE USING ELECTRICALLY CONDUCTIVE PARTS OF ONE OR MORE COMPONENTS OF THE LISTENING DEVICE

TECHNICAL FIELD

The present application relates to listening devices, in particular listening devices adapted for being located in the ear canal of a user. The disclosure relates specifically to a miniature listening device comprising a housing for (fully or partially) enclosing an energy source and a number of functional and/or electronic components of the listening device.

The application moreover relates to use of a listening device, to a method of electrically connecting a listening device to an external device and to a listening system.

The disclosure may e.g. be useful in applications such as miniature hearing aids or ear phones or active ear plugs.

BACKGROUND ART

Space is a scarce resource in miniature listening devices adapted for being located at or in an ear of a user. An example of such devices is hearing aids. This is of course even more the case in a deep in the ear canal type hearing aid.

Direct (e.g. galvanic) electrical connection to a listening device may occasionally be necessary for particular purposes. A particular purpose may e.g. include the programming of the listening device or the charging of a rechargeable energy source (e.g. a battery) of the listening device. Typically, separate electrical connections are established in the listening device for such purposes.

A separate electrical connection to an external device may e.g. be implemented by a plug or (typically) a socket connector located in or on a housing of the listening device. The connector is adapted for electrically connecting the listening device to the external device via a connecting element comprising a connector of the opposite kind (socket or plug, respectively) in or on the external device (or, typically, in a connecting cable electrically connected to the external device).

DE 102008024515 B3 describes a hearing aid comprising a signal processing electronic circuit arranged in a housing that has an opening formed as a through-flow opening for sound or air. The opening is connected with a loudspeaker or a microphone as a sound outlet or sound inlet, or is formed as the through-flow opening guided through the housing, where the loudspeaker or microphone is arranged in the housing. An electrical contact is arranged in the opening, which is contactable from outside of the housing and is connected with the electronic circuit.

DISCLOSURE OF INVENTION

In an aspect of the present disclosure, an electric connection (e.g. a galvanic connection) to an electric part of a listening device from an external device is made via a connecting element (external to the listening device), e.g. a connector or a contacting pin, to an electrically conducting (e.g. metallic) part of one or more components of the listening device. An advantage thereof is that separate electrical connections adapted for a specific purpose can be avoided or reduced in number, and volume in the listening device thereby saved.

An object of the present application is to provide a scheme for electrically connecting a miniature listening device to an external device.

Objects of the application are achieved by the invention described in the accompanying claims and as described in the following.

A Miniature Listening Device:

An object of the application is achieved by a miniature listening device comprising a housing for enclosing an energy source and a number of functional and/or electronic components of the listening device, wherein a first functional component comprises an electric contact part, which is physically accessible from outside the housing, and wherein an electronic component and/or said energy source—at least in a specific connected mode—is electrically connected to said electric contact part of the first functional component, whereby an electric connection from an external device to said electronic component and/or to said energy source of the listening device can be established.

This has the advantage of providing a listening device that uses a minimum of space on electrical contacts to external devices.

In an embodiment, the first functional component is selected from the group comprising a wax-filter, a microphone, a speaker, a microphone inlet, a speaker outlet and combinations thereof.

In an embodiment, the listening device comprises a programmable component, e.g. a signal processing unit. In an embodiment, one of the electronic components is a programmable component, e.g. a signal processing unit.

In an embodiment, the listening device comprises a memory, e.g. a non-volatile memory, for permanently or temporarily storing data related to the functioning of the listening device, e.g. related to signal processing to be carried out by the listening device, e.g. various processing parameters related to one or more (e.g. manually or automatically) selectable programs of the listening device. In an embodiment, the memory is accessible from or form part of the programmable component, e.g. a signal processing unit.

In an embodiment, the electric contact part (of the functional component) does not otherwise form part of an electric connection related to the functionality of the functional component itself (possibly, other than fixing the casing of a component to a specific electric potential (e.g. grounding)) or other electronic circuitry of the listening device. In other words, the use of the electric contact part of the functional component in question has nothing to do with the normal way of operation of the component and ideally does not influence said operation.

In an embodiment, the listening device is adapted to be brought into a special connected mode intended for providing connectivity to an external device via the electric contact part of the first functional component. To implement such connected mode, the listening device may comprise a number of controllable switches that provides appropriate electrical connectivity between the electric contact part of the first functional component and the electronic component in question and/or the energy source of the listening device. In an embodiment, connectivity in the connected mode is controlled by the signal processing unit. In an embodiment, connectivity in the connected mode is controlled by a remote control. In an embodiment, connectivity in the connected mode is controlled by a user, e.g. via an activation element on the listening device or via a remote control. In an embodiment, such remote control capability form part of the external device (e.g. a programming device or a charging station) to which electrical connection is to be established. The controllable switch or switches may e.g. be implemented as transistor switches. Preferably, the switches are implemented as a part of a signal processing unit and e.g. controlled by it. In an embodiment, the listening device comprises a wireless receiver adapted for receiving control commands from a remote device, e.g. a remote control of the listening device, the control commands including instructions regarding the setting of the controllable switch or switches.

In a preferred embodiment, the electric connection is a galvanic connection. In other words, the electric connection is formed by a direct (as opposed to a wireless) connection between the two devices or parts to be connected.

In a preferred embodiment, the electric contact part is accessible through an opening in the housing of the listening device. In an embodiment, the opening in the housing of the listening device form part of the function of the first functional component of the listening device (or of another functional component). In an embodiment, the opening is specifically adapted to allow a galvanic connection to be established.

In a preferred embodiment, the first functional component comprises an electrically conductive part or section. In a preferred embodiment, the electrically conductive part is a housing of or form part of a housing of the first functional component. In an embodiment, the electric contact part of the first functional component is located on or form part of the electrically conductive part. In a preferred embodiment, the housing of the first functional component comprises or is constituted by a metallic part.

In an embodiment, the first functional component is specifically adapted to comprise an electrically conductive part, such as a metallic part. In an embodiment, an electrically conductive part is applied to the surface of an otherwise insufficiently conducting or electrically insulating material. In an embodiment, an electrically conductive part is applied by a coating technology, e.g. a deposition technique. In an embodiment, electrically conducting material is removed from the first functional component to create an island of electrically conductive material providing the electric contact part.

In an embodiment, a major part, such as all of the housing of the listening device is made of an electrically insulating material. In an embodiment, the housing of the listening device comprises one or more metallic parts.

In an embodiment, the listening device is adapted to provide a frequency dependent gain to compensate for a hearing loss of a user, thereby comprising functionality of a hearing instrument.

In an embodiment, the listening device comprises a forward path between an input transducer (microphone system and/or direct electric input (e.g. a wireless receiver)) for converting an input sound to an electric inputs signal and an output transducer for converting an electric signal to a stimulus perceived by the user as an acoustic signal (e.g. a speaker). In an embodiment, a signal processing unit is located in the forward path. In an embodiment, the signal processing unit is adapted to provide a frequency dependent gain according to a user's particular needs. In an embodiment, the listening device comprises an antenna and transceiver circuitry for receiving a direct electric input signal. In an embodiment, the listening device comprises demodulation circuitry for demodulating the received direct electric input to provide the direct electric input signal representing an audio signal and/or a control signal.

In an embodiment, the listening device further comprises other relevant functionality for the application in question, e.g. acoustic feedback suppression, etc.

In an embodiment, the frequency range considered by the listening device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, the frequency range $f_{mm}$-$f_{max}$ considered by the listening device is split into a number P of frequency bands, where P is e.g. larger than 5, such as larger than 10, such as larger than 50, such as larger than 100. In an embodiment, at least some of the frequency bands are processed individually.

A Listening System:

In a further aspect, a listening system is provided, the listening system comprising a listening device as described above, in the detailed description of 'mode(s) for carrying out the invention' and in the claims, and an external device for being electrically connected to the listening device, at least in a specific connected mode, via said functional component of the listening device.

In an embodiment, the external (connecting) device comprises or is connectable to a connecting element for establishing electrical connection to said listening device. In an embodiment, the connecting element is an integral part of the external device. In an embodiment, the connecting element is a specific part, separate from the external device.

In an embodiment, the connecting element comprises a specific connector, e.g. a plug and/or one or more contact pins.

In an embodiment, a contact pin comprises a conic tip of an electrically conductive material, e.g. comprising Cu, Ag or Au or a combination thereof.

Use of a Listening Device:

Use of a listening device as described above, in the detailed description of 'mode(s) for carrying out the invention' and in the claims is furthermore provided by the present application.

In an embodiment, use for recharging the energy source is provided. In an embodiment, use for transferring data to a memory of the listening device is provided. In an embodiment, use for programming a programmable component of the listening device is provided.

A Method of Electrically Connecting a Listening Device to an External Device:

A method of electrically connecting a listening device to an external device, the listening device comprising a housing for partially enclosing an energy source and a number of functional and/or electronic components of the listening device is moreover provided by the present application. The method comprises a) Providing that a first functional component comprises an electric contact part, which is physically accessible from outside the housing, b) Providing a connected mode of the listening device adapted for providing an electrical connection between the external device and an electronic component and/or said energy source of the listening device; and in the connected mode c) Providing that an electronic component and/or said energy source (of the listening device) is electrically connected to said electric contact part of the first functional component;

d) Providing an external connecting element, which is electrically connected to the external device and adapted for being electrically connected to the electric contact part of the first functional component;

e) Establishing an electric connection between the external connecting element and the electric contact part (of first functional component of the listening device).

It is intended that the structural features of the device described above, in the detailed description of 'mode(s) for carrying out the invention' and in the claims can be combined with the method, when appropriately substituted by a corresponding process and vice versa. Embodiments of the method have the same advantages as the corresponding devices.

In an embodiment, a rechargeable battery of a listening device is charged by an external current source via connections to a wax-filter and/or a microphone inlet or a speaker/receiver outlet and/or a speaker/receiver (e.g. a casing) and/or a microphone (e.g. a casing).

In an embodiment, a programmable component of the listening device is programmed by an external programming unit via connections to a wax-filter and/or a microphone inlet or a speaker/receiver outlet and/or a speaker/receiver (e.g. a casing) and/or a microphone (e.g. a casing).

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

MODE(S) FOR CARRYING OUT THE INVENTION

Figure 1A:
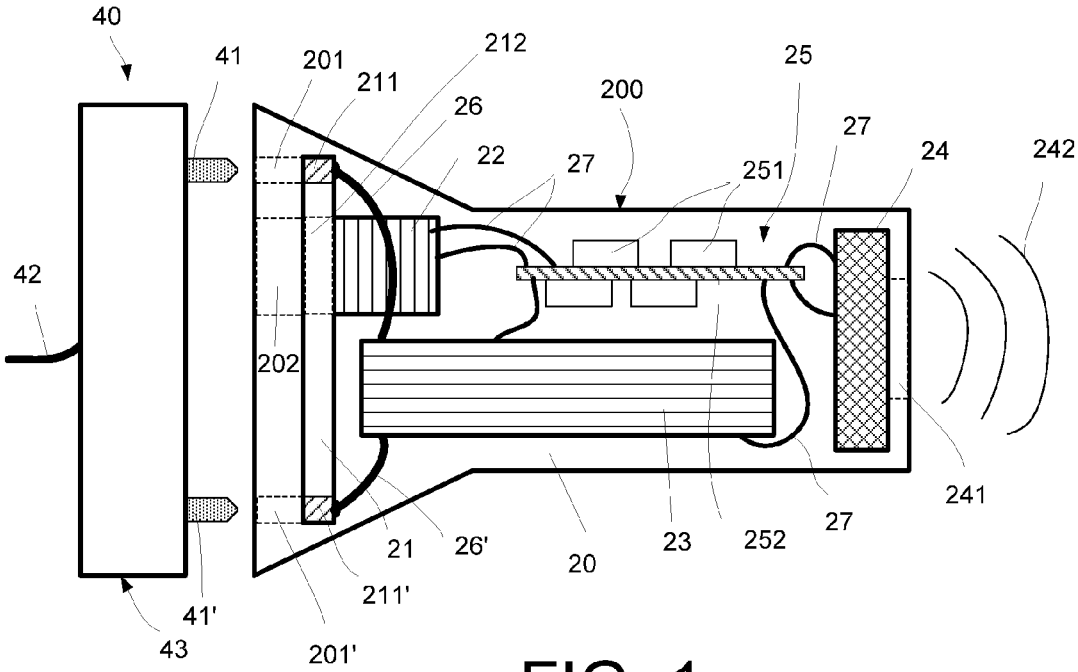
FIG. 1 shows a listening device and a connecting element to an external device according to an embodiment of the present disclosure, FIG. 1*a* illustrating a first embodiment in a non-connected mode, FIG. 1*b* illustrating the first embodiment in a connected mode, and FIG. 1*c* illustrating a second embodiment in a non-connected mode.
Figure 1B:
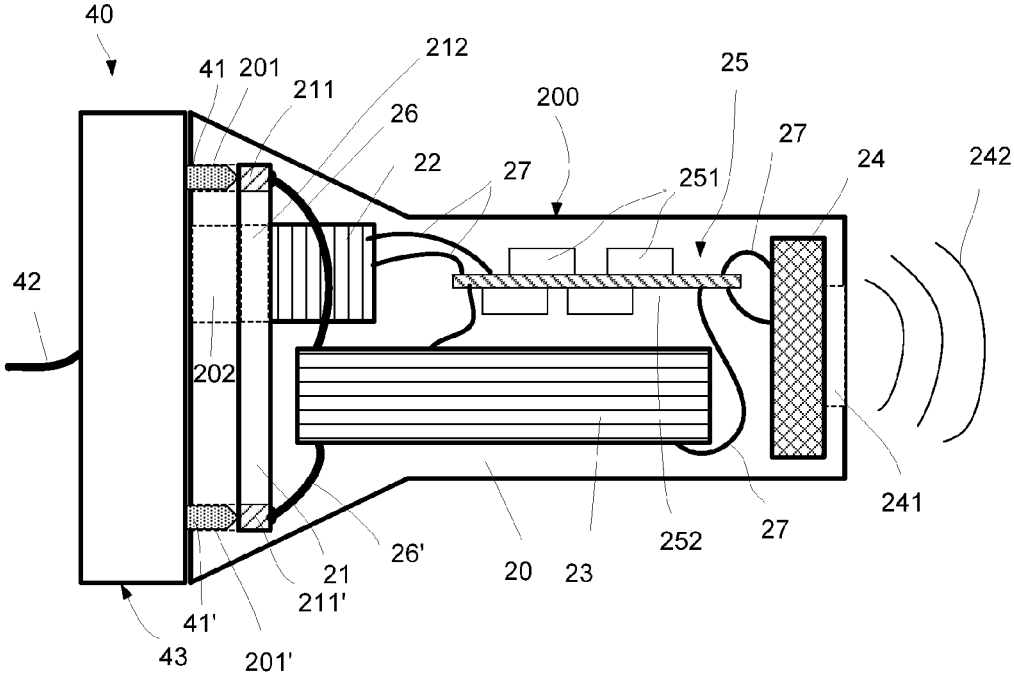
Figure 1C:
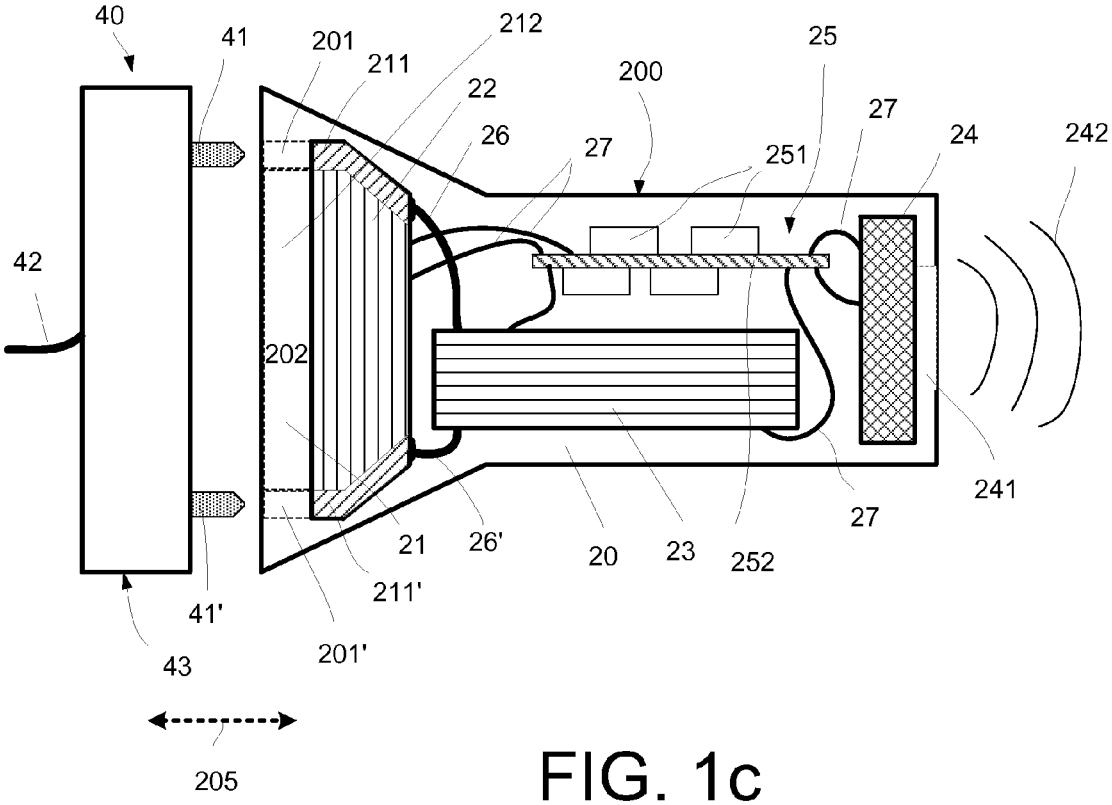

FIG. 1 shows a listening device 20 and a connecting element 40 to an external device (not shown) according to an embodiment of the present disclosure. FIG. 1*a* shows a first embodiment in a non-connected mode, whereas FIG. 1*b* shows the first embodiment in a connected mode. FIG. 1*c* shows a second embodiment in a non-connected mode.

In general, the embodiments of a listening device of FIG. 1 comprise a housing 200, e.g. of an electrically insulating material, e.g. a plastic material (or a of mixture of electrically insulating and electrically conductive materials). The embodiments shown are adapted for being located in an ear canal of a user, e.g. fully or partly in the bony part of the ear canal. The listening device 20 comprises a number of functional components and a number of electronic components, which together with mechanical parts of the housing and its interior provide the functionality of the listening device. The embodiment of a listening device of FIG. 1 comprises functional parts in the form of a microphone 22 and a loudspeaker 24. The listening device further comprises a local energy source 23 (e.g. a battery, here a rechargeable battery) and a printed circuit board 25 comprising a substrate 252 and a number of electronic components 251, which are electrically interconnected on (and/or in intermediate layers of) the substrate. On the substrate, one or more of the functional components may further be mounted. The listening device further comprises electrical connections 27 for connecting the components of the printed circuit board 25 to other parts of the hearing aid (here microphone 22 and speaker 24). The housing 200 comprises one or more openings, 241, 202, which is/are adapted for providing or enhancing the functionality of said functional component(s), here in the form of microphone 22 and speaker 24, respectively. The opening 241, e.g., allows speaker 24 to appropriately propagate its acoustic output 242 to a user's eardrum. The connecting element 40 comprises a plug housing 43 with contacting pins 41, 41' and a number of electrical conductors 42 for electrically connecting the contacting pins to an external device. The connecting element is indicated to comprise (at least) two connecting pins 41, 41' (the listening device comprising corresponding openings 201, 201' and electric contact parts 211, 211'). More than two, e.g. 3 or 4, connecting pins may be established, if necessary, depending on the application. Preferably, the connecting element and the listening device are specifically adapted to allow only one (=the correct) way of mounting the connecting element on the listening device. In an embodiment, this is accomplished in that the connecting pins are located asymmetrically on the plug housing. Alternatively, the form of the housing of the listening device and the plug housing in combination with the location of the connecting pins and the corresponding openings are such that only one (obvious) way of mounting is possible.

In the embodiment of FIG. 1*a*, 1*b* the functional component used for connecting an external device to a local energy source 23 in the listening device is a wax-filter 21. The wax-filter is adapted to comprise a number of electrically conductive (e.g. metallic) areas 211, 211' (contact parts) along its periphery (electrically insulated from each other by electrically insulating intermediate parts of the periphery (see e.g. parts 213 in FIG. 2*f*)). The electrically conductive parts may e.g. be applied by a coating process. The wax-filter comprises an active filter area 212 (e.g. a mesh) for preventing or delaying serumen (wax) and/or other fluid or solid elements to enter the microphone inlet. The active filter area may cover an area corresponding to the relevant area of the microphone 22 (as indicated in FIG. 1) or, alternatively, more or less. The housing 200 comprises two openings 201, 201' adapted for allowing contact pins 41, 41' of a connecting element 40 to establish electrical connection to respective contact parts 211, 211' of functional component 21, here wax-filter 21, when the contacting pins 41, 41' of contacting element 40 are operationally inserted in the corresponding openings 201, 201', respectively, as illustrated in FIG. 1*b*. The listening device of FIG. 1*a*, 1*b* comprises electrical connections 26, 26' for connecting the electric contact parts 211, 211', respectively, to the two terminals of the rechargeable battery 23 of the listening device. Thereby an electrical connection from the battery to an external device (e.g. a charging station for recharging the rechargeable battery 23) can be established.

The embodiment of a listening device of FIG. 1*c* is different from the embodiment of FIG. 1*a*, 1*b* in that the functional component used for connecting an external device to a local energy source 23 in the listening device is the microphone 22 instead of the wax-filter 21. The microphone housing comprises (or is adapted to comprise) two mutually electrically independent electric contact parts 211, 211'. The embodiment of a listening device of FIG. 1*c* does either not comprise a wax-filter, or, if present (as shown in FIG. 1*c*), is adapted to allow contact pins 41, 41' to make electrical contact to the electric contact parts of the microphone (e.g. via through holes or indentations 201, 201' in the periphery of the of wax-filter). In an embodiment, the opening comprising volumes 201, 202, 201' is one coherent opening. In an embodiment, two or more openings are separate from the other by a wall. FIG. 1*c* shows the listening device in an un-connected mode. Connected and un-connected modes of operation of the listening device are indicated by arrow 205 (corresponding to FIGS. 1*b* and 1*a*, respectively).

Figure 3A:
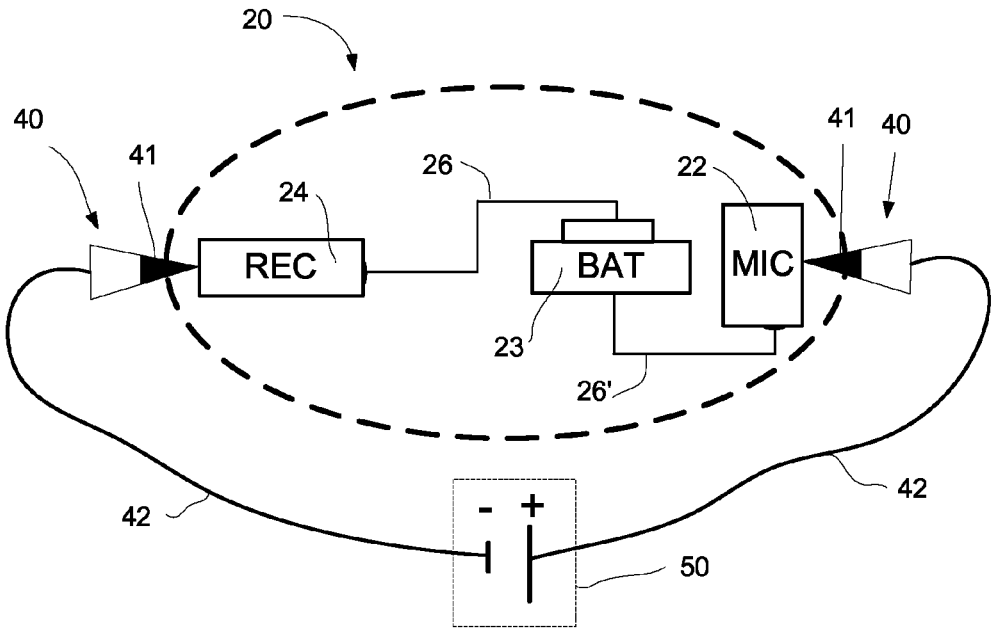
FIG. 3 shows various embodiments of a listening system in a connected mode according to embodiments of the present disclosure, the system comprising a listening device, a charging station for charging a local energy source of the listening device, and a connecting element for electrically connecting the listening device to the charging station, FIG. 3*a*-3*c* showing various embodiments of the listening device utilizing different functional components for establishing the electric connection to the external device.
Figure 3B:
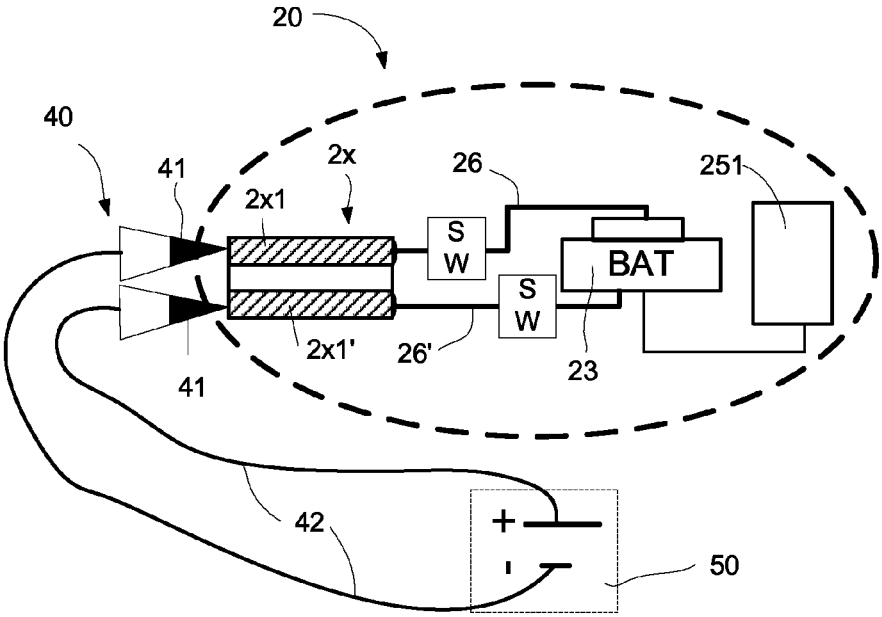
Figure 3C:
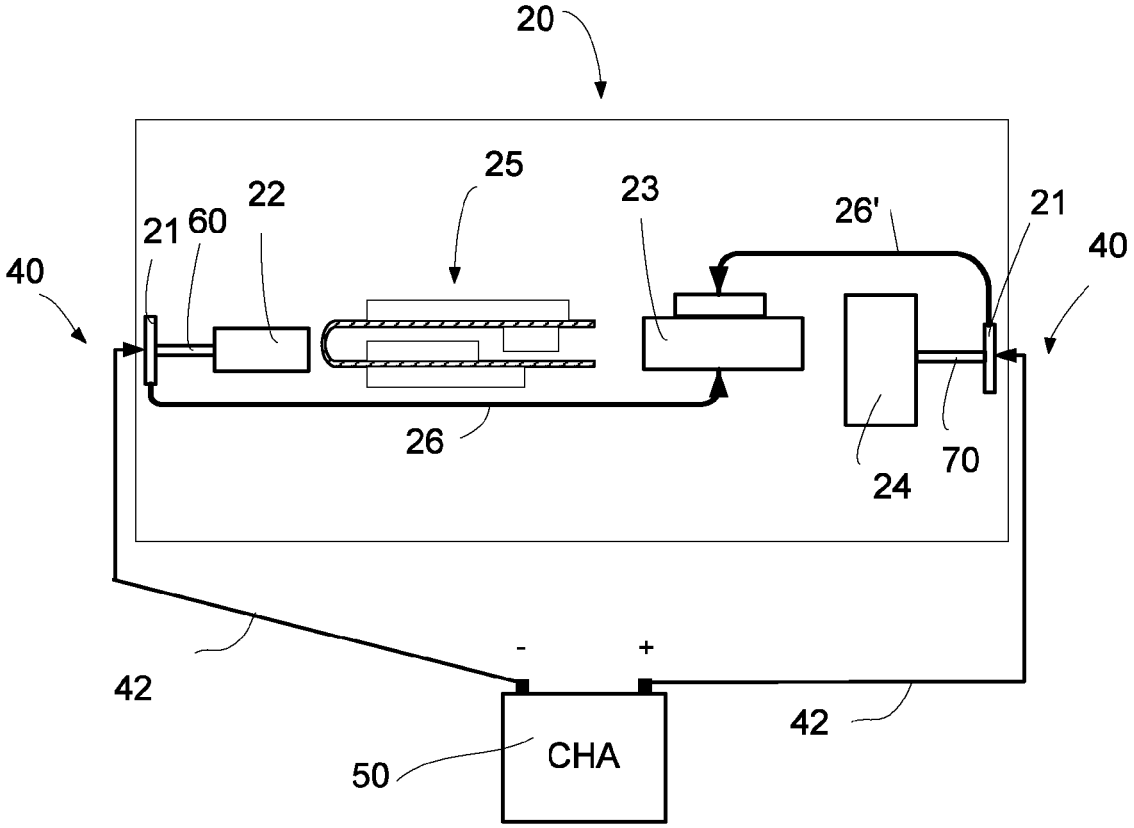
Figure 4:
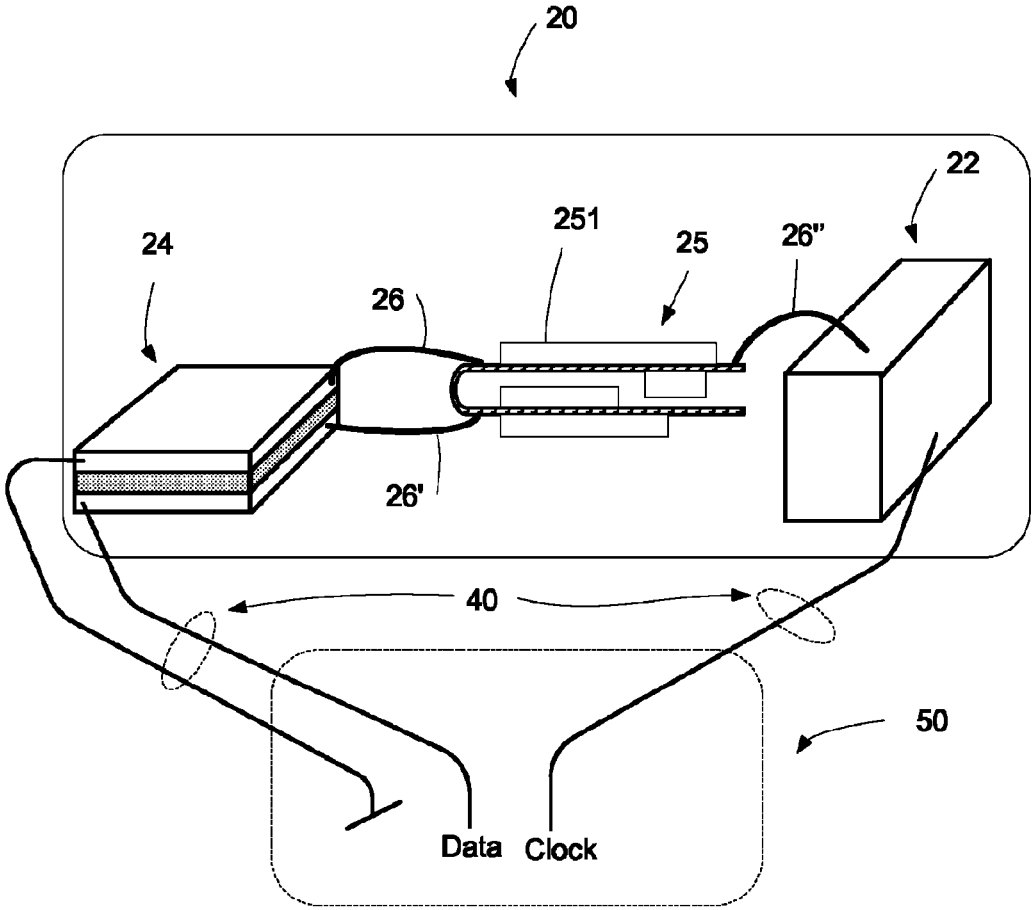
FIG. 4 shows an embodiment of a listening system in a connected mode according to an embodiment of the present disclosure, the system comprising a listening device, a programming device for programming a signal processor of the listening device, and a connecting element for electrically connecting the listening device to the programming device whereby 3 conductors are used for programming the signal processor.
Figure 5:
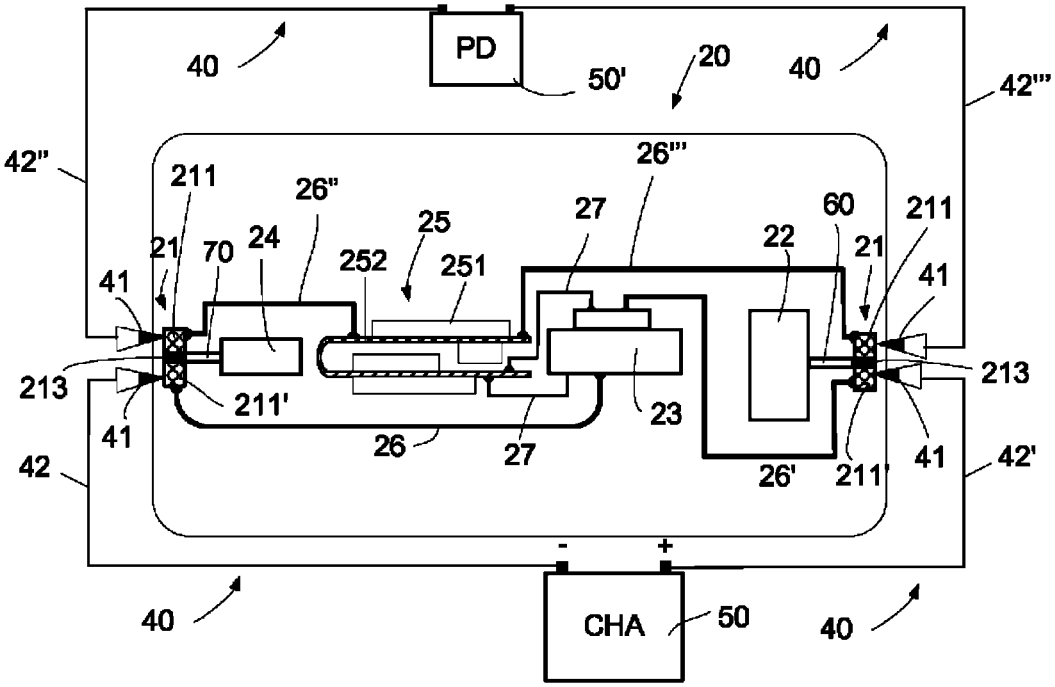
FIG. 5 shows an embodiment of a listening system in a connected mode according to an embodiment of the present disclosure, the system comprising a listening device, a programming device for programming a signal processor of the listening device, a charging station for charging a local energy source of the listening device and a connecting element for electrically connecting the listening device to the programming device and the charging station, whereby 2 (external) conductors are used for programming the signal processor and 2 (external) conductors are used for charging.

FIG. 1 shows a specific form of a listening device in the form of a deep-in-the-ear-canal hearing instrument and a possible connecting element using two different functional components (wax filter 21 and microphone 22, respectively) for creating an electrical connection between the battery 23 of the listening device and an external device (e.g. a measurement instrument or a charging station, see e.g. FIG. 3-5).

Similarly electric connection using a connecting element 40 from an external device to metallic parts of a variety of functional components of a listening device (e.g. a hearing aid) can be established as shown in FIG. 2*a*-2*f*.

Figure 2A:
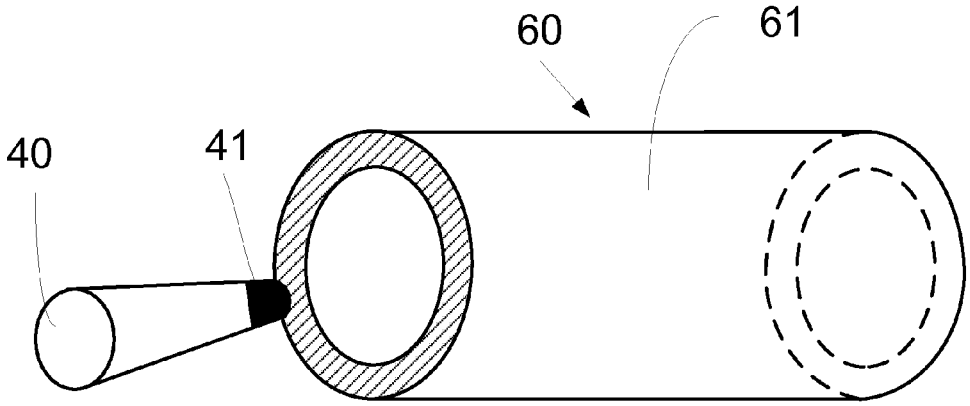
FIG. 2 shows various functional components and a connecting element according to various embodiments of the present disclosure, FIG. 2*a* showing a functional component in the form of a sound inlet.
FIG. 2*b* showing a functional component in the form of a sound outlet.
FIG. 2*c* showing a functional component in the form of an output transducer (e.g. a receiver/loudspeaker)
FIG. 2*d* showing a functional component in the form of an input transducer (e.g. a microphone or a microphone system)
FIG. 2*e* showing a functional component in the form of a first wax-filter.
FIG. 2*f* showing a functional component in the form of a second wax-filter.

FIG. 2*a* shows a functional component in the form of a sound inlet 60. The sound inlet 60 can e.g. be used in connection with a microphone, to guide sound signals towards the active area of the microphone. The sound inlet may be of any material, e.g. a plastic material. In an embodiment, however, the sound inlet 60 comprises at least an electrically conductive part 61 suitable for making contact to a connecting element and to an electronic component and/or a local energy source of the listening device. Such electrically conductive part can e.g. be an electrical conductor 61 provided in the longitudinal direction of the sound inlet tube. Preferably, the sound inlet comprises an electrically conductive layer (e.g. a metallic layer). In an embodiment, the sound inlet is made of an electrically conductive material, e.g. comprising Al or Cu. A connecting element 40 comprising a contact pin 41 is shown to establish electrical contact to an electric contact part of the sound inlet.

Figure 2B:
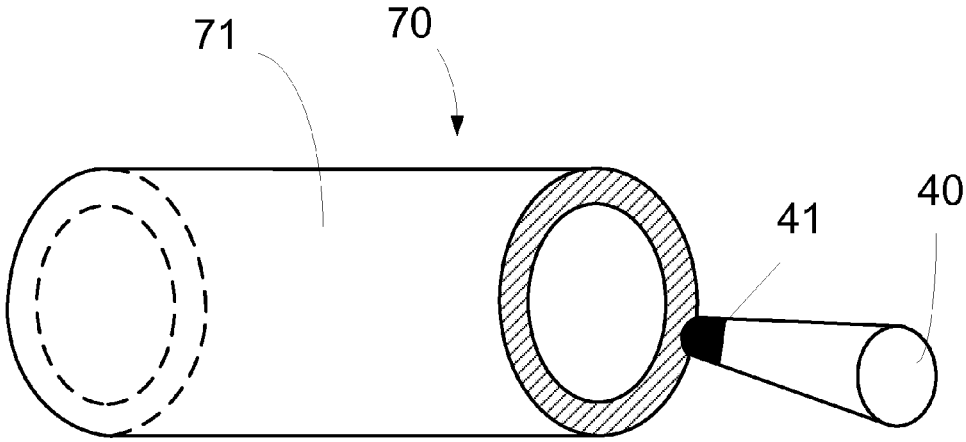

FIG. 2*b* shows a functional component in the form of a sound outlet 70. The sound outlet 70 can e.g. be used for guiding sound from a speaker/receiver of the listening device towards an eardrum of a user. The same properties and embodiments as mentioned for the sound inlet 60 may prevail for the sound outlet, including the electrically conductive part 71 of the sound outlet.

Figure 2C:
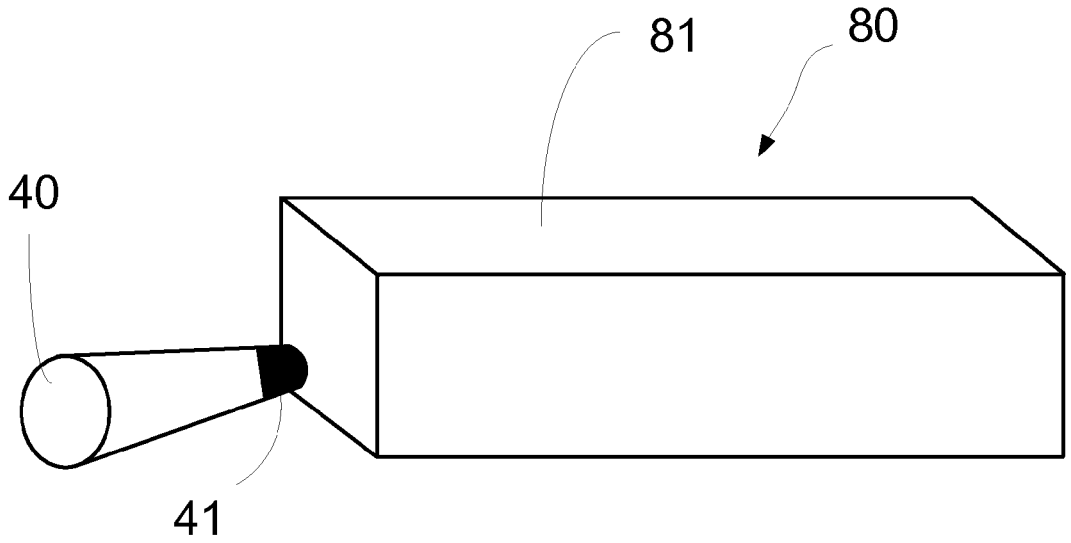

FIG. 2*c* shows a functional component in the form of an output transducer 80 (e.g. a receiver/loudspeaker). In an embodiment, the output transducer is enclosed by a housing, e.g. a metallic housing. In an embodiment, the output transducer (e.g. the housing) comprises an electrically conductive part 81. In an embodiment, the output transducer (e.g. the housing) comprises a number of mutually electrically insulated electrically conductive parts 81. A connecting element 40 comprising a contact pin 41 is shown to establish electrical contact to an electric contact part 81 of the output transducer 80.

Figure 2D:
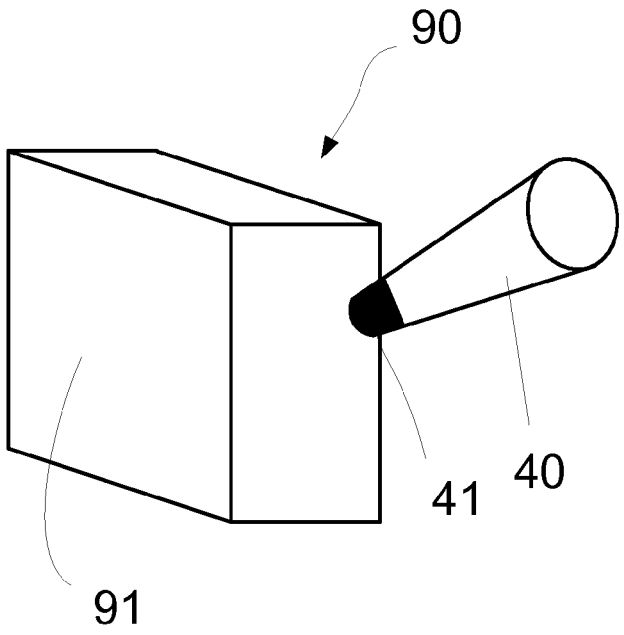

FIG. 2*d* shows a functional component in the form of an input transducer 90 (e.g. a microphone or a microphone system). In an embodiment, the input transducer is enclosed by a housing, e.g. a metallic housing. In an embodiment, the input transducer (e.g. the housing) comprises an electrically conductive part 91. In an embodiment, the input transducer (e.g. the housing) comprises a number of mutually electrically insulated electrically conductive parts 91. A connecting element 40 comprising a contact pin 41 is shown to establish electrical contact to an electric contact part 91 of the input transducer 90.

Figure 2E:
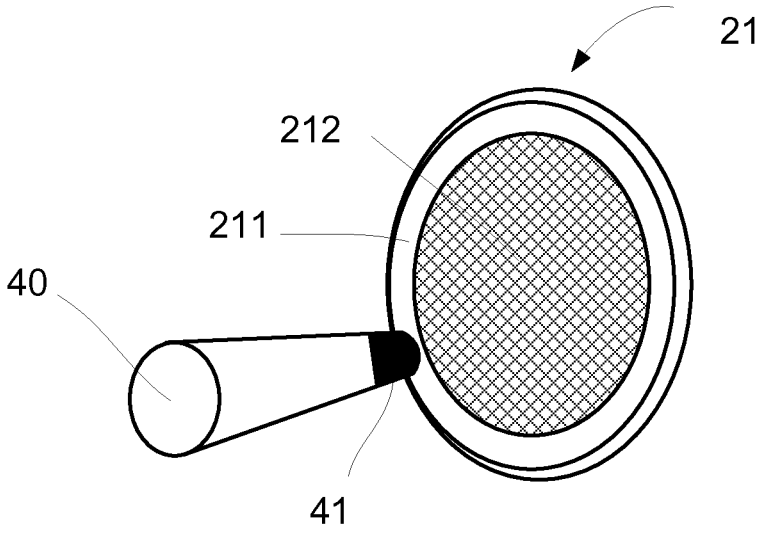
Figure 2F:
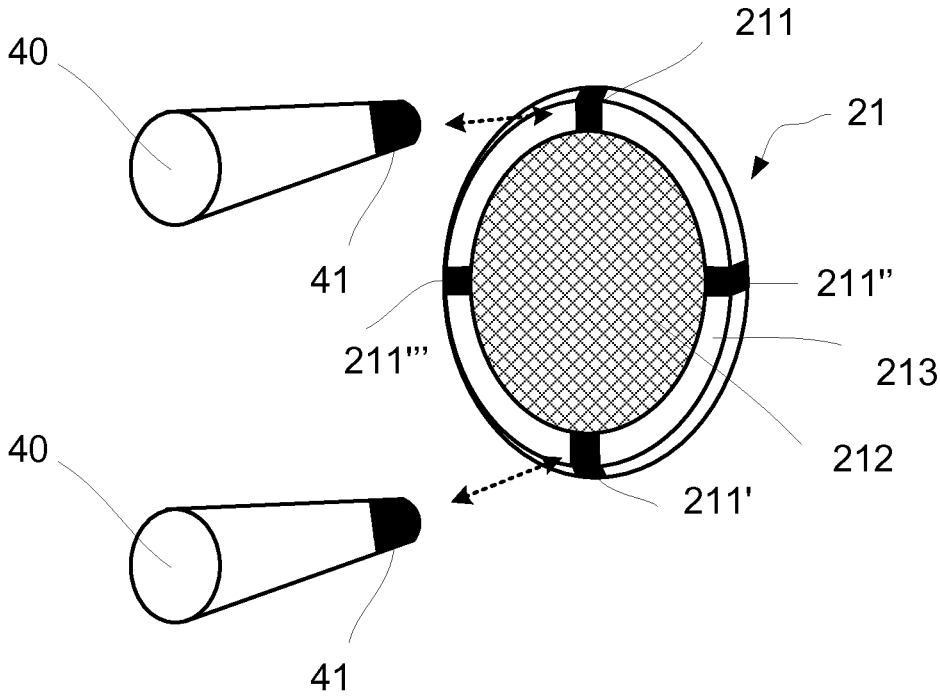

FIGS. 2*e* and 2*f* show a functional component in the form of first and second wax-filter embodiments.

A wax-filter is typically used in front of a functional component to allow the functional component (such as a speaker, a microphone, or a vent channel) to be in communication (i.e. 'capable of exchanging (acoustic) energy') with the environment or the ear canal. Preferably, the wax-filter or a part of a wax-filter for a speaker (or a microphone) is adapted to allow appropriate acoustic propagation of sound from the speaker (or to the microphone) through the wax filter, at least when the wax filter is not tainted with wax. Similarly, the wax-filter or a part of a wax-filter for a vent is preferably adapted to allow at least a part of the sound pressure variations present in the volume facing the ear drum of a user to be relieved to the environment through the vent of the listening device (to minimize the occlusion effect), when the listening device is operationally mounted in the ear canal.

The embodiments of wax-filters 21 shown in FIG. 2*e*, 2*f* comprise a substantially circular peripheral frame and a mesh-like filter spanned by the frame, the mesh being optimized for preventing or delaying the propagation of serumen through the mesh, while allowing acoustic sound to appropriately propagate through the filter. Other forms of wax-filters may be used depending on the specific application. A connecting element 40 comprising one (FIG. 2*e*) or more (FIG. 2*f*) contact pins 41 is shown to establish electrical contact to an electric contact part 211 (or 211, 211', 211", 211'") of the wax-filter 21.

In the embodiment of FIG. 2*e*, only one electric contact part 211 is provided in that the whole peripheral frame of the wax-filter is electrically conducting, e.g. made of metallic material or having a metallic coating. Thereby a contact pin can be positioned anywhere on the periphery of the wax-filter and still provide electrical contact. In the embodiment of FIG. 2*f*, several (here 4) electric contact parts 211, 211', 211", 211'" are provided in that the whole peripheral frame of the wax-filter is electrically non-conducting, e.g. made of plastic material, and an appropriate number of electric contact parts being established on the periphery, e.g. by applying a metallic coating (allowing electrical contact to the contacting pins 41 as well as to electronic components or a battery of the listening device where the wax-filter is used (cf. e.g. FIG. 1, 3, 5). The electric contact parts 211, 211', 211", 211'" are separated by electrically insulating segments 213 of the peripheral frame of the wax-filter 21. In an embodiment, an electric connection from an external device or component to the wax-filter is made by a connecting element comprising a specific connector in the form of a connecting plug. The electric contact parts of the wax-filter may thus be connected to any appropriate electric component or connecting area (e.g. a contact pad on a substrate, cf. e.g. PCB 25 in FIG. 1) or a battery in the listening device.

In embodiments of the present disclosure, electrical connection, such as a specific electrical connection, to an electronic component and/or to the energy source of the listening device is established using more than one functional component, such as 2, 3 or more functional components. In an embodiment a specific electrical connection for connecting an external device to an electronic component and/or to the energy source of the listening device is established using one or more of the components a wax-filter, a sound inlet, and a microphone, or using one or more of the components a wax-filter, a sound outlet and a receiver/speaker.

In an embodiment, the listening device comprises one or more switches allowing a specific electrical connection for connecting an external device to an electronic component and/or to the energy source of the listening device—at a given time—to be used either for connecting the external device to a specific electronic component or to the energy source of the listening device. Thereby the same physical connection from the electric contact part of the functional component(s) involved in establishing the connection in question to the switch in question can be used for establishing electrical contact to an external device from several different electronic components and the energy source at different times. In an embodiment, the listening device comprises a wireless receiver adapted for receiving control commands from a remote device, e.g. a remote control of the listening device, the control commands including instructions regarding the setting of the controllable switch or switches to implement a connection of an external device to specific electronic component(s) or to the energy source.

FIG. 3 shows various embodiments of a listening system in a connected mode according to embodiments of the present disclosure, the system comprising a listening device, a charging station for charging a local energy source of the listening device, and a connecting element for electrically connecting the listening device to the charging station, FIG. 3*a*-3*c* showing various embodiments of the listening device utilizing different functional components for establishing the electric connection to the external device.

FIG. 3*a*-3*c* show various battery charging scenarios where an external power source 50 is electrically connected to a rechargeable battery 23 of the listening device 20 (e.g. a hearing aid) via electrical connections to various functional components accessible from outside of the listening device (hearing aid) housing, e.g. the metallic casings of the speaker and microphone, respectively, a microphone inlet, a speaker outlet, a filter, etc.

In FIG. 3*a* a battery BAT (23) of listening device 20 is recharged by charging station or a battery 50 using connecting elements 40 with electrical conductors 42 and contact pins 41, the latter being connected to electric contact parts of a speaker REC (receiver, 24) and microphone MIC (22) components. In the listening device 20 the electrical connection between the electric contact parts of the functional components 24, 22 and the battery BAT (23) is established by electrical conductors 26 and 26' respectively.

In FIG. 3*b* a battery BAT (23) of listening device 20 is recharged by charging station or a battery 50 as shown in and described for FIG. 3*a*. In the listening device 20 the electrical connection is established using two electric contact parts 2*x*1, 2*x*1' of the same functional component 2*x*, e.g. a speaker 24 (x=4) or a microphone 22 (x=2). The electrical connection between the electric contact parts 2*x*1, 2*x*1' of the functional component 2*x* and the battery BAT (23) is established by electrical conductors 26 and 26' respectively. In the embodiment of FIG. 3*b*, switches SW are inserted in the paths of electrical conductors 26 and 26' allowing the connection to the external device to be switched on or off. The switches are e.g. controlled by an onboard selection unit, e.g. electronic component 251, e.g. a signal processing unit, possibly via a user interface or controlled by a (e.g. wirelessly) received signal.

In FIG. 3*c* a battery BAT (23) of listening device 20 is recharged by charging station or battery CHA (50) as shown in and described for FIG. 3*a*. In the listening device 20 the electrical connection is established using electric contact parts on two functional components in the form of wax-filters 21 located in front of sound inlet 60 and microphone 22 components and in front of sound outlet 70 and speaker 24 components, respectively. The electrical connection between the electric contact parts of the functional components (here wax filters 21) and the battery 23 is established by electrical conductors 26 and 26' respectively. In the embodiment of FIG. 3*c*, a printed circuit board (PCB) 25 comprising electronic components, e.g. a signal processing unit mounted on a substrate is shown. Connections from the PCB to other components of the listening device may exist, but are, however, not shown in FIG. 3*c*.

FIG. 4 shows an embodiment of a listening system in a connected mode according to an embodiment of the present disclosure, the system comprising a listening device 20, a programming device 50 for programming a signal processor 251 (and/or a memory) of the listening device, and a connecting element 40 for electrically connecting the listening device to the programming device, whereby 3 conductors (here termed Ground, Data, and Clock) are used for programming the signal processor. Access to the programmable component 251 from the programming device 50 is established via functional parts in the form of speaker 24 and microphone 22. Two separate electric contact parts are used on the speaker 24 to establish connections 26, 26' to the PCB 25 and from there to the programmable component 251, whereas a single electric contact part is used on the microphone 22 to establish connection 26" to the PCB 25 and from there to the programmable component 251. The electric contact parts may e.g. be established on (possibly different parts of) a metallic casing of the functional components in question.

FIG. 5 shows an embodiment of a listening system in a connected mode according to an embodiment of the present disclosure. The system comprises a listening device 20, a programming device PD (50') for programming a signal processor 251 of the listening device 20, a charging station CHA (50) for charging a local energy source 23 of the listening device and a connecting element 40 for electrically connecting the listening device to the programming device and the charging station, whereby 2 conductors (42", 26"), (42'", 26'") are used for programming the signal processor and 2 conductors (42, 26), (42', 26') are used for charging the battery.

The embodiment of FIG. 5 comprises the same components as the embodiment shown in and described in connection with FIG. 3*c*. Additionally, the embodiment of FIG. 5 comprises a programming device PD (50') electrically connected to a programmable component 251 on PCB 25 and corresponding electrical connections in the listening device. This allows a combined data transfer (e.g. programming) and recharging scenario. The electrical connection between the electric contact parts 211' of the functional components, wax-filters 21, and the battery 23 is established by electrical conductors 26 and 26', respectively. The electrical connection between the electric contact parts 211 of the functional components, wax-filters 21, and PCB 25 and from there to the programmable component 251 is established by electrical conductors 26" and 26'", respectively. Further electrical connections in the listening device between battery 23 and PCB are denoted 27. The two wax-filters 21, each comprise two electric contact parts 211, 211' separated by an electrically insulating part 213 (as e.g. indicated in FIG. 2*f*, where 4 electric contact parts are shown).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

DE 10 2008 024 515 B3 (Siemens Medical Instruments) 01.04.2010

The invention claimed is:

1. A miniature listening device comprising:

a housing for enclosing an energy source and a number of functional and electronic components of the listening device, a supporting one of the functional and electronic components includes an electric contact part, which electric contact part is physically accessible from outside the housing, wherein the supporting one of the functional and electronic components is selected from the group consisting of a wax-filter, a microphone, a speaker, a microphone inlet, a speaker outlet and combinations thereof, an electrically functioning one of the energy source and the functional and electronic components is electrically connected to said electric contact part, wherein an electric connection from an external device to the electric contact part can be established, and said supporting one of the functional and electronic components has a functionality that is not related to supporting the electric contact part.

2. A listening device according to claim 1 wherein the functional and electronic components comprise or form part of a signal processing unit.

3. A listening device according to claim 1 wherein said electric connection is a galvanic connection.

4. A listening device according to claim 1 wherein said electric contact part is accessible through an opening in said housing.

5. A listening device according to claim 4 wherein said opening assists with a function of said one functional component.

6. A listening system comprising a listening device according to claim 1 and an external device adapted to be electrically connected to the listening device via said electric contact part of the listening device.

7. A listening system according to claim 6 wherein said external device comprises or is connectable to a connecting element for establishing electrical connection between said external device and said listening device.

8. A listening system according to claim 7 wherein said connecting element comprises a plug and/or one or more contact pins.

9. A listening device according to claim 1 wherein the miniature listening device is a hearing aid.

10. A listening device according to claim 1 wherein the miniature listening device is a hearing aid adapted to be located in the ear canal of a user.

11. A method of electrically connecting a listening device to an external device having an external connecting element, the listening device comprising a housing for at least partially enclosing an energy source and a number of functional and electronic components of the listening device, wherein:

a supporting one of the functional and electronic components includes an electric contact part, which electric contact part is physically accessible from outside the housing, and an electronically functioning one of the functional and electronic components and said energy source is electrically connected to said electric contact part, and the external connecting part is adapted to be electrically connected to the electric contact part, the method comprising:

establishing an electric connection between the external connecting element and the electric contact part, wherein one or more electric connections is/are established via functional and electronic components selected from the group consisting of a wax-filter, a microphone inlet, a speaker/receiver outlet, a speaker/receiver, a microphone and combinations thereof.

12. A method according to claim 11 wherein the external device is a current source and wherein the method provides charging the energy source of the listening device.

13. A method according to claim 11 wherein the external device is an external programming unit and wherein the method provides programming a programmable component of the listening device.

* * * * *